United States Patent [19]

Martin et al.

[11] Patent Number: 5,062,597

[45] Date of Patent: Nov. 5, 1991

[54] METHOD OF FORMING A NEW PILE AFTER DISCHARGE OF A COMPLETED PILE IN A PILE-FORMING MACHINE ASSOCIATED IN PARTICULAR WITH A PRINTER AND DEVICE FOR CARRYING OUT THIS METHOD

[75] Inventors: Martial G. E. Martin, Villejuif, France; Pierre L. V. Nuttin, Massagno, Switzerland

[73] Assignee: Syntone, Belgium

[21] Appl. No.: 494,777

[22] Filed: Mar. 16, 1990

[30] Foreign Application Priority Data

Mar. 17, 1989 [FR] France ..... 89 03560

[51] Int. Cl.[5] ..... B41L 1/32

[52] U.S. Cl. ..... 270/39; 493/410; 493/412

[58] Field of Search ..... 270/30, 31, 39, 52.5; 493/410–415

[56] References Cited

U.S. PATENT DOCUMENTS

| | | | |
|---|---|---|---|
| 4,460,350 | 7/1984 | Mittal et al. | 493/412 |
| 4,730,762 | 3/1988 | Felix | 270/39 |
| 4,842,573 | 1/1989 | Peter | 270/39 |

FOREIGN PATENT DOCUMENTS

| | | | |
|---|---|---|---|
| 0187344 | 7/1916 | European Pat. Off. . | |
| 46226 | 2/1982 | European Pat. Off. | 270/31 |
| 3344347 | 6/1985 | Fed. Rep. of Germany . | |
| 1376538 | 9/1964 | France . | |
| 236973 | 11/1985 | Japan | 270/31 |
| 2177686 | 1/1987 | United Kingdom . | |

*Primary Examiner*—Edward K. Look
*Assistant Examiner*—Therese M. Newholm
*Attorney, Agent, or Firm*—Steinberg & Raskin

[57] ABSTRACT

A method of forming a new pile after the discharge of a completed pile in a machine for forming piles in zigzag fashion from a flexible web, the method consisting in rupturing the web at a transverse perforation line located between the last flap of the pile being formed and the first flap of the new pile to be formed, advancing the ruptured web until the forward edge of the first flap reaches a position corresponding to its final position at the base of a new pile, stopping the swinging unit, lowering the supporting table for discharge of the completed pile and providing a pressure air cushion underneath the zone of the forward edge of the first flap which forms a temporary support during the absence of the supporting table, removing the temporary supporting cushion when the table has returned to its working position and restarting the operation of the swinging unit.

9 Claims, 4 Drawing Sheets

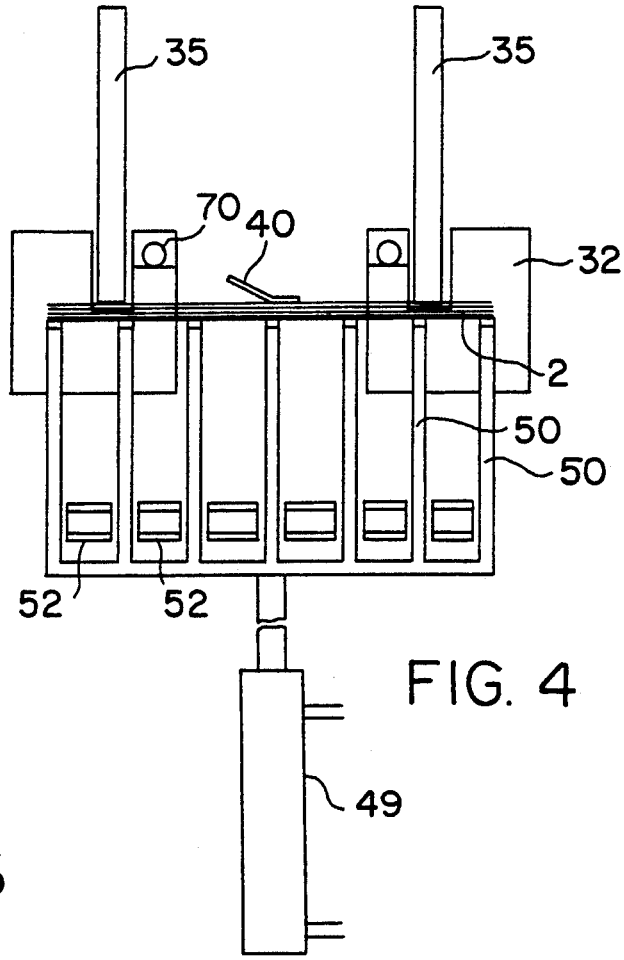
FIG. 4
FIG. 3
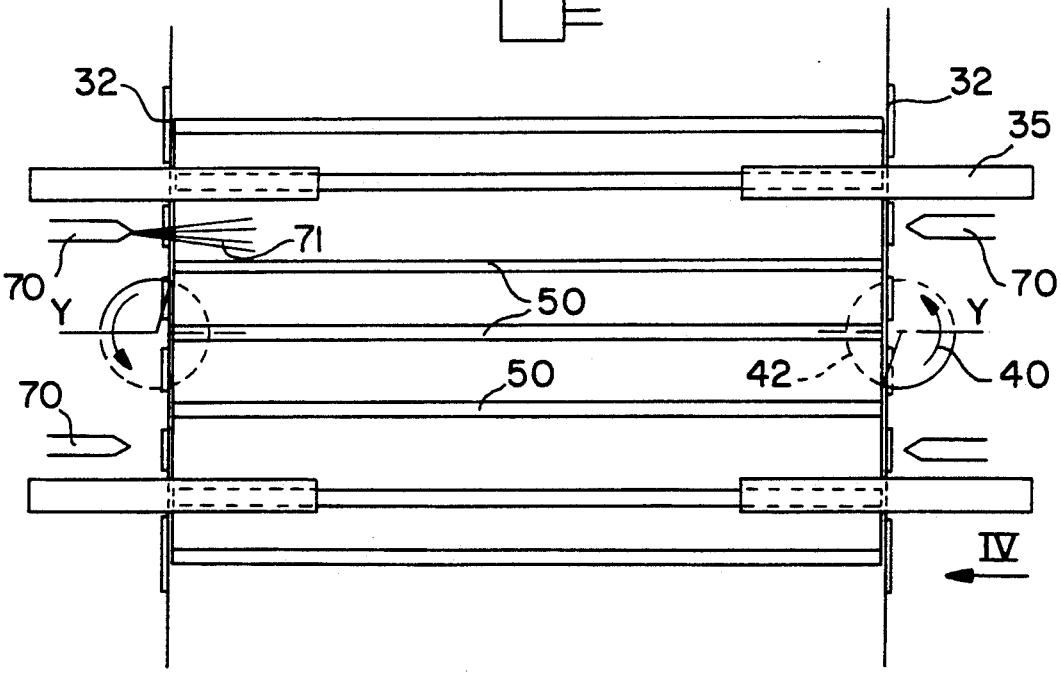

METHOD OF FORMING A NEW PILE AFTER DISCHARGE OF A COMPLETED PILE IN A PILE-FORMING MACHINE ASSOCIATED IN PARTICULAR WITH A PRINTER AND DEVICE FOR CARRYING OUT THIS METHOD

The present invention relates to a method of forming a new pile or stack after the discharge of a completed pile or stack in a pile-forming machine from an endless web or strip of flexible material such as paper coming from a processing device such as a printer, in particular a computer printer through zigzag folding of the web or strip along pre-established transverse folding lines such as transverse perforation lines defining flaps therebetween on a table for supporting piles movable advantageously vertically between a flap stacking working position and a withdrawn position of discharge of a completed pile, by means of a swinging unit performing a pivoting motion above the supporting table. The invention is also directed to a device for carrying out this method.

Methods and devices of this kind are already known. According to the known methods the web or strip is caused to break at the transverse perforation line located between the last flap of the pile being built up and to be completed and the first flap of the new pile to be built up; the web or strip is caused to move forward to cause the last flap of the pile being formed to be laid down, the movement of the swinging unit is caused to stop, the supporting table is lowered, the completed pile is discharged, the table is raised or lifted again into its working position and the operation of the swinging unit is restarted.

These known methods and the devices for carrying them out have the major inconvenience of being too complicated and of requiring a specific equipment inconsistent with the rate of operation for instance of quick working printers in particular of computers.

The object of the present invention is to provide a method and a device which do no longer exhibit the drawbacks of the prior state of the art.

To reach that goal the method according to the invention is characterized in that it consists in advancing the broken web until the forward or leading edge of the first flap of the new pile to be formed reaches a position corresponding to its final position at the base of the new pile, stopping the swinging device, lowering the supporting table with a view to discharge the completed pile and providing a gaseous fluid cushion advantageously of air below the forward or leading edge zone of the first flap which forms a temporary support during the absence of the supporting table, removing the supporting cushion when the table has come back to its working position and restarting the operation of the swinging device.

According to an advantageous characterizing feature of the invention the temporary supporting cushion is adjusted so that the aforesaid forward edge zone of the first flap be kept in a position wherein this zone forms with respect to a horizontal plane an angle small enough to provided for the proper positioning of the said forward edge zone onto said table.

The device for carrying out the method according to the invention is characterized in that the means for forming the gaseous fluid cushion comprise a device with nozzles arranged on each side of the supporting table at the folds of the flaps laid down so as to apply jets of gaseous fluid onto the bottom surface of the first flap to be laid down.

According to another characterizing feature of the invention this device comprises at least two nozzles which are arranged at each side of the table so as to produce substantially parallel jets in a substantially horizontal plane.

According to still another advantageous characterizing feature the strength of the fluid jets is adjustable in accordance with the substance and with the size of the material forming the flaps.

The invention will be better understood and further objects, characterizing features, details and advantages thereof will appear more clearly as the following explanatory description proceeds with reference to the accompanying diagrammatic drawings given by way of non limiting example only illustrating a presently preferred specific embodiment of the invention and wherein:

FIG. 1 is a diagrammatic elevational view of a pile forming machine for carrying out the method according to the invention;

FIG. 2 diagrammatically shows on a larger scale the portion indicated at II in FIG. 1 and comprising the device for specifically performing the method according to the invention;

FIG. 3 is a view seen in the direction of the arrow III of FIG. 2 the pile being in the course of formation and the lower portion of the machine having been omitted;

FIG. 4 is a partial view seen in the direction of the arrow IV of FIG. 2.

Figure 1:
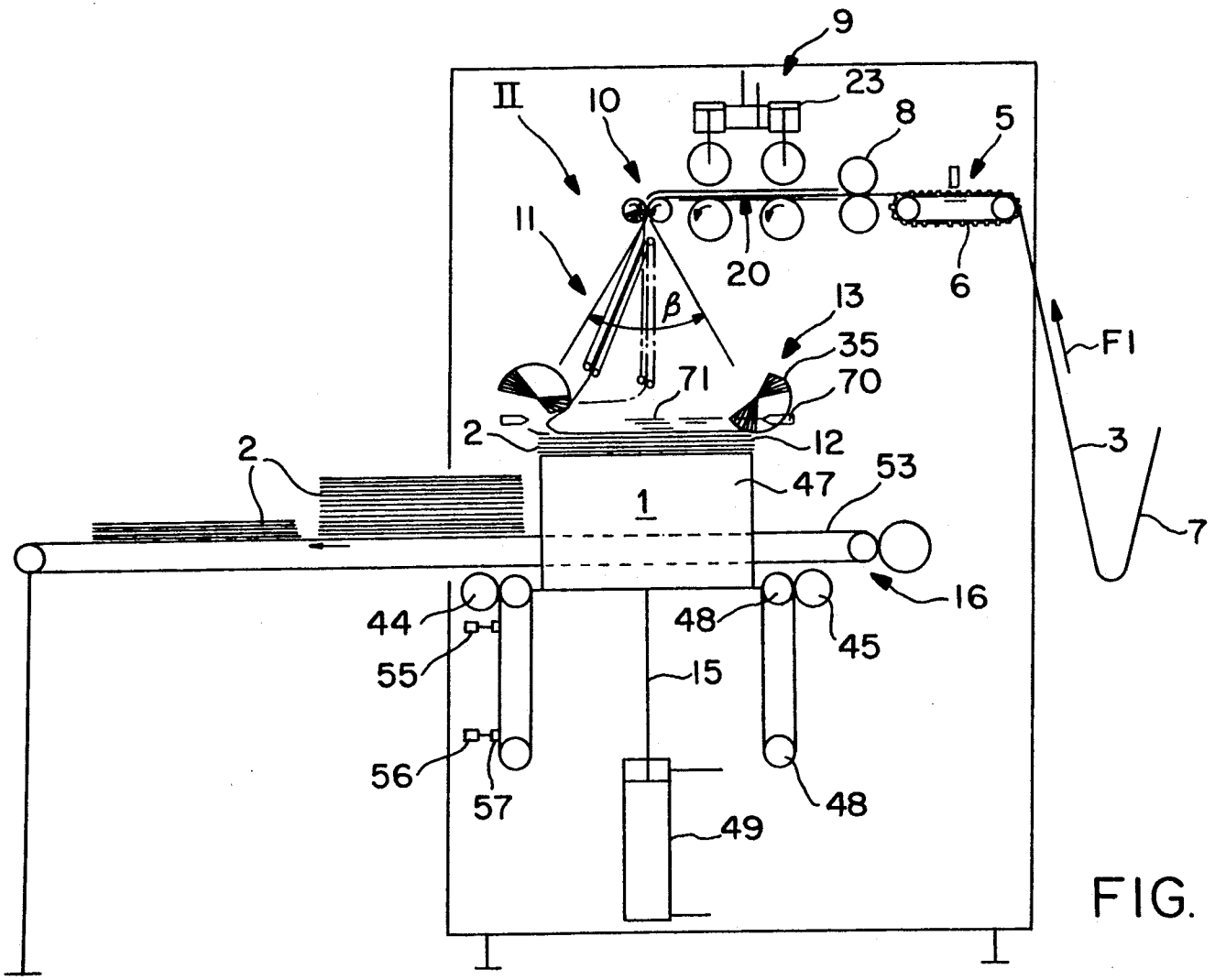

FIG. 1 diagrammatically shows the machine according to the invention which is adapted to form on a supporting device 1 piles or stacks 2 into a zigzag configuration from an endless web or strip 3 of a suitable flexible material in particular of paper which is supplied by a machine not shown arranged before for instance a computer printer, of the laser type. This endless web comprises longitudinal perforations of the Caroll holes type and transverse weakening lines such as perforation lines which constitute lines of folding the web into its zigzag configuration on the support 1. The longitudinal and transverse perforations are known per se and have not been shown.

The machine essentially comprises according to the embodiment shown successively in the direction of advancing motion of the web 3 as designated by the arrow F1, a device 5 comprising two notched or serrated belts provided with sprockets 6 adapted to engage the Caroll holes of the web 3 to provided for the drive of the web 3 forming upstream of the device 5 a loop 7, edge cutting members 8, a web separating or severing unit 9 adapted to make a break in the web along one predetermined breaking line formed of a transverse perforation line, a device 10 for deviating or leading the web towards a swinging unit 11 known per se which performs a pendular movement in an angular area in accordance with the sizes of the folding flaps defined between two adjacent weakening and folding lines of the web. The function of this swinging device is to lay the endless web 3 down onto the support 1 according to a zigzag configuration for building up a pile or a stack. The machine moreover comprises at each side edge designated at 12 a unit 13 for flattening and retaining flaps on a pile being formed and the first flap of a new pile as will be described in detail later. The reference numerals 15 and 16 designate means for displacing the supporting device 1 and the means for discharging a completed pile, respectively of the machine according to the invention.

Figure 2:
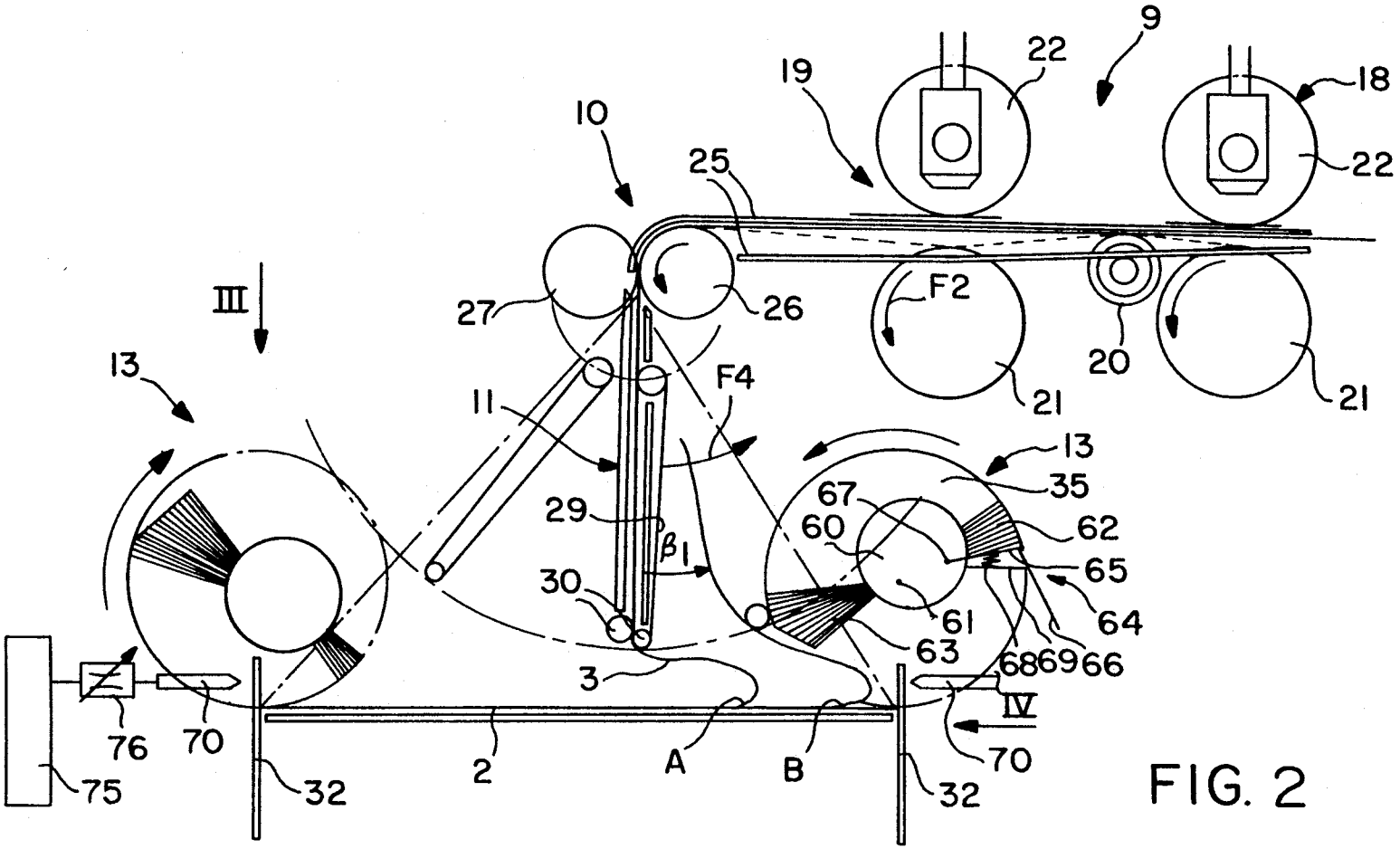

With reference to FIGS. 2 to 4, the various important devices constituting the machine shown on FIG. 1 will described more in detail hereinafter.

As shown in FIGS. 1 and 2 the device 9 for separating or severing the web 3 along the breaking line provided by the transverse perforation line connecting the last flap of the pile being formed to the first flap of the new pile essentially comprises two pairs 18, 19 of rolls located upstream and downstream, respectively, of a number of elements 20 with rupturing edges which are juxtaposed just underneath the web 3 in the transverse direction with respect to the web. Both rolls 21, 22 of the two pairs of rolls 18, 19 are arranged below and above the web, respectively, at a predetermined distance or spacing, their axis extending at right angles to the direction of advancing motion of the web 3 in parallel relation to the plane thereof when it is in its normal advancing position shown in solid lines. Both bottom rolls 21 are mounted for rotation about stationary axes and are advantageously rotated by suitable drive means as shown by arrows F2. Both top rolls 22 are mounted for rotation about axes displaceable at right angles to the plane of the web 3 by means of suitable hydraulic actuators or jacks mounted in a common support 23. The rolls 22 are displaceable in a translatory motion between the position shown remote from the top surface of the web 3 and a position in which they deviate the web at right angles to its normal position until it closely engages the peripheral surface of the bottom drive rolls 21. In this position the web 3 is in the position shown in broken lines. Under the action of the thrust or pushing force of the rolls 22 the elements with rupturing edges 20 are rupturing the web, the lowering of the rolls 22 being operated when the transverse perforation line forming the preset rupturing line is at the level of the elements 20.

To provide for the guiding of the web 3 upon its normal travel and of said last and first flaps after severing of the web there is provided a device 25 for guiding the web up and down which extends from a position upstream of the first pair 18 of rolls down to the deviating device 10 while becoming wider in the direction perpendicular to the plane of the web as shown in FIG. 2. This guide channel 25 exhibits recesses in its upper and lower walls which allow the rolls 21 and 22 to enter the inside of the channel. As to the deviating device 10 it comprises a drive roll 26 which advantageously extends throughout the width of the web like the rolls 21 and 22 and for instance two or more brushes 27 which are axially juxtaposed over the width of the web 3 in parallel relation to the axis of the rolls 26 and arranged so as to provide for the applying of the web against the peripheral surface of the drive roll 26 by engaging the other surface of the web in pressed relationship.

As shown in FIG. 2 the guide channel 25 performs a web guide and buffer storage effect up to the level of engagement of the web between the roll 26 and the brushes 27. The paper web 3 clamped between the roll 26 and the brushes 27 is inserted into the swinging unit 11 essentially comprising flat belts 29 revolving at the speed of the notched or serrated belts 6 while guiding the web 3 therebetween and rollers 30 one of which is a drive roller and which are located at the free end of the swinging unit. Thus the web is carried along down to the outlet from the swinging unit. The swinging unit alternately distributes the folding flaps to the assemblies 13 for flattening and retaining the flaps.

Referring in particular to FIG. 3 there is seen that each unit 13 essentially comprises at each corner of the laying plane a rotary member 35 formed of a brush and advantageously shaped as a segment of a circle with an angle advantageously above 180° so that a flap just laid is caused for a short period of time to bear at each fold by the members 35. The latter are shaped as brushes. Each one of these brushes 35 is rotated about an axis extending in parallel relation to the laying plane and to the folds of the flaps located on the support 1 at a distance and at a place above the laying plane of the flaps advantageously slightly offset or shifted outwards. Owing to this arrangement of the brushes 35 they constitute means for flattening and smoothing out or pressing down the folds.

In a particular advantageous embodiment such a brush comprises a hub 60 which is eccentric with respect to the axis of rotation 61 of the brush so that the bristles shown at 63 vary in length on the periphery of the hub in the manner shown. The lengths of the bristles increase in the direction reverse from the direction of rotation of the brush. The fitting or set of the bristles moreover exhibits a forward portion 63 in which the lengths of the bristles decrease gradually with respect to the diameter of the brush in the direction of rotation thereof. Owing to this forward or leading portion 63 the brush 38 has a shape owing to which the brush engages the loop of the web 3 gently without there being any risk of formation of an incipient or beginning fold at a place other than the transverse perforation line separating two adjacent flaps.

The hub 60 carries downstream of the fitting or set of bristles 62 a hammering device 64 for flattening or smoothing out the folds. This device comprises an arm 65 for supporting a hammer element 66 of an elongated shape. The supporting arm is mounted at the periphery of the hub 60 for pivoting motion about an axis 67 substantially parallel to the axis 61 of the brush against a compression spring 68 directed substantially in the direction of the periphery of the brush and bearing upon an element 69 made fast with the hub 60. The element 69 is located downstream of the supporting arm 65 with respect to the direction of rotation of the brush. The hammer member 66 exhibits an angle of for instance 120° with respect to the supporting arm 65 and is directed in the direction opposite to the direction of rotation of the brush. Under such circumstances the hammer member would exert a pressure upon the folding zone already previously flattened out by the set of bristles of the brush and would provide for the smoothing out or pressing down of this area under the action of the spring 68 then compressed.

The device 1 for supporting the piles essentially comprises a receiving table 47 mounted to be vertically movable under the action of chain sprocket wheels 48 and of an actuator or jack 49. For the downward motion of the table 47 is driven by the chain sprocket wheels 48, the actuator or jack 49 remaining inoperative. This movement would stop when the helical coil 40 stops getting on the flaps forming the pile. The upward movement is controlled by the actuating jack 49. The receiving table 47 exhibits a comb structure as clearly shown in FIGS. 3 and 4. The flaps arranged in a zigzag fashion are thus resting on vertical wall elements 50 which are arranged in parallel relationship with each other while leaving between any two adjacent elements a space used for the passage of a conveyor element shaped as an endless belt 52. The whole of these conveyor elements placed side by side would constitute an endless conveyor track 53 (FIG. 1) for discharging the completed piles from the machine as illustrated in FIG. 1. It is seen that such a wall 50 is below each brush 35 and therefore works as a bearing surface. In this FIG. 1 have also been shown at 55 and 56 upper and lower limit switches, respectively, for restricting the stroke of the receiving table 47 through co-operation with a boss 57 associated with the table 47 and more specifically with a chain reeved over the wheels 48.

An important peculiarity of the invention is the fact that it comprises means forming a temporary support for the first flap of a new pile to be formed during the period of discharging a completed pile, i.e. when the supporting device 1 is lowered.

Figure 5:
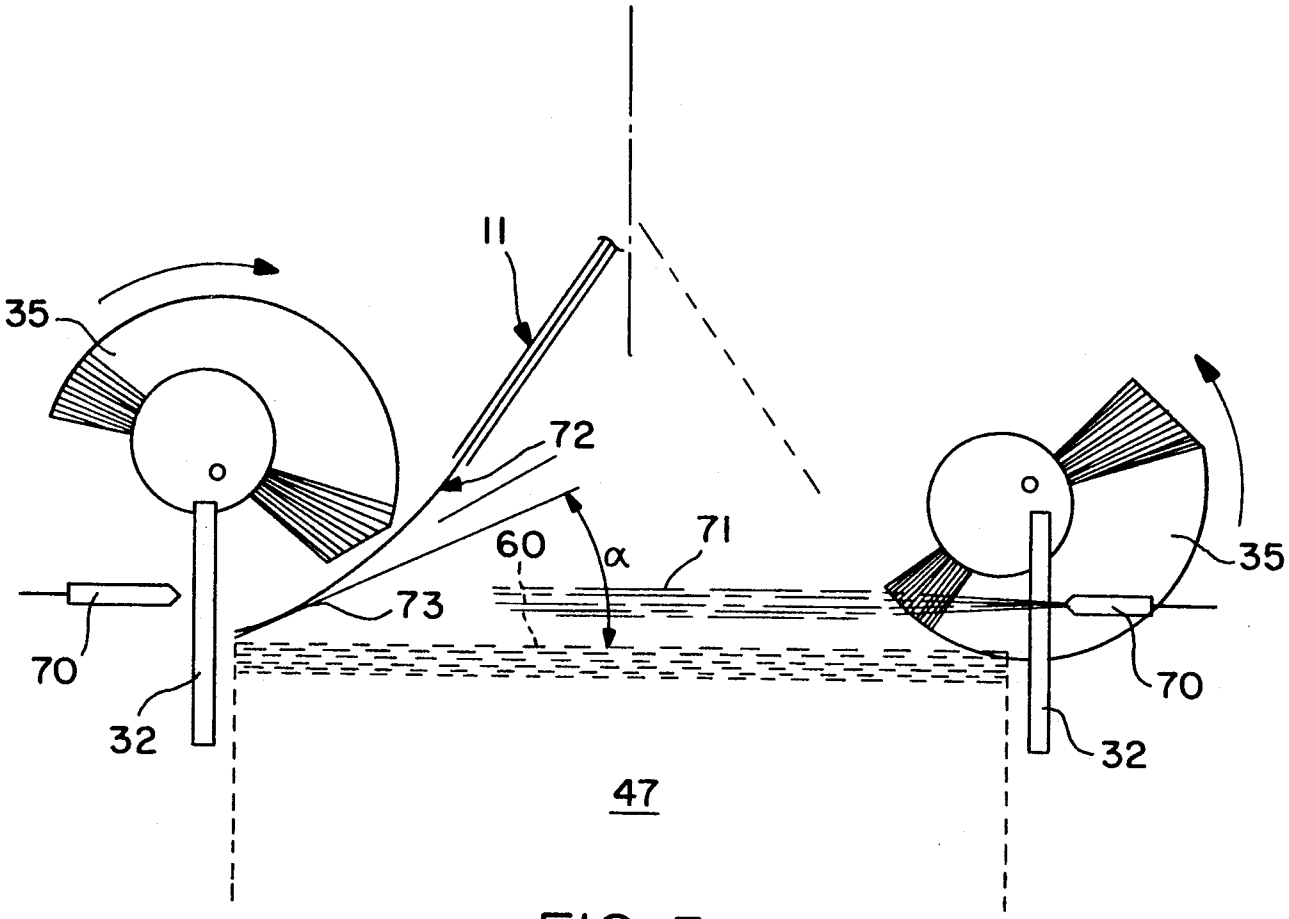
FIG. 5 is a diagrammatic illustration of the method according to the present invention.

These temporary supporting means essentially comprise at least two nozzles 70 on each side of the laying plane between two flattening brushes 35. The nozzles 70 are located in the space between the laying plane and the lowermost point of the path of travel of the end of the swinging member 11. They are oriented so as to provide two jets 71 of a gaseous fluid under pressure such advantageously as air adapted to form a fluid bearing cushion for the forward or leading edge of the first flap of the new pile to be formed as shown in FIG. 5 wherein the above-mentioned first flap and the leading or forward edge thereof are designated at 72 and 73, respectively. To adjust the fluid pressure in accordance with the material of the flaps, i.e. to the substance and to the size when there is a paper web the nozzles 70 are fed with fluid from a source of pressure fluid 75 through the agency of a pressure adjusting device diagrammatically shown at 76. The jets 71 are directed at right angles to the folds of the flaps. The number of nozzles 70 on either side of the laying plane is of course also a function of the specific weight or of the sizes of the flaps.

The operation of the machine according to the invention and the method performed through such an operation are described hereinafter.

It is easily understood that when being displaced according to a back-and-forth or reciprocating pivoting movement as shown in particular in FIG. 2 the flaps are laid down in a zigzag configuration onto the supporting device. The brushes 35 upon revolving in synchronism with the movement of the swinging member 11 would flatten and smooth out or press down the folds of the flaps, this effect being perfect owing to the hammers 66, the action upon the flap to be laid down being carried out gently owing to the configuration shown of the leading or forward portions 63 of the brushes. As the flaps are laid down the supporting device 1 formed of the receiving table would move slowly downwards.

During this pile forming step the measuring helical coils 40 are rotating in synchronism with the brushes 35. The helical coils are freely displaceable upwards on their axis of rotation under the effect of the increase in the number of the flaps laid down onto the receiving table 47. They may pass onto the pile of flaps laid down owing to their raised portion 41. Once moved past or having exceeded a determined height the corresponding helical coil would operate through the medium of an electric switch the cut-off of the brake 44 and the switching on of the motor-reducer set 45. The receiving table 47 driven by the chain sprocket wheels 48 would then move downwards. The movement would stop when the helical coil stops getting onto the piles of the flaps laid down.

At the end of the build-up of a pile the discharge thereof from the machine and the preparation for the formation of a new pile will be described hereinafter with reference in particular to FIGS. 2 and 5. When a detecting cell or pick-up sensor shown at 59 in FIG. 1 at the device 5 having notched or serrated belts is reading a code provided on the web 3 it would program in relation to time the actuator jacks 23 of the web separation device 9 which would lower the upper rolls 22 lined or covered with rubber at the time where the perpendicular rupture perforation line is located between both pairs of rolls 18 and 19 of the device 9 but preferably before the separating rollers 20. The roll 21 of the pair 18 is rotating at the speed of the belt 6 whereas the roll 21 of the pair 19 is advantageously rotating a little quicker than the transverse perforation line is passing over the rupture elements 29. This would cause the web to break or rupture. Both actuator jacks 23 of the device 9 are then causing the rolls 22 to move upwards again. The end of the web, i.e. the last flap of the pile being formed and the first flap of the new pile to be formed are kept between the guides of the device 25. The roll 26 and the brushes 27 would keep the severed web driven at the speed of the belts 6. It should be pointed out that the spacing between the last flap shown at 60 (FIG. 5) of the completed pile and the first flap 72 of the pile to be formed is very small.

The swinging unit continues its movement of laying the flaps down until the leading or forward edge 73 of the first flap 72 reaches the position shown in FIG. 5 close to or against the corresponding abutment cheek 32. This Figure shows in broken lines the outline or contour of the pile completed by the laying down of the last flap 60. It is seen that the leading or forward edge 73 then assumes the position which will be its position at the base of the new pile.

It is at that time that the order is given to begin the cycle of discharge of the completed pile by the stoppage of the belts 6, of the rolls 21, 26, of the brushes 35, of the swinging unit 11 together with its belts 29 and the rollers 30 and of the brushes 35. The brake 44 is released and the actuator jack 49 causes the receiving table 47 to move down quickly.

It is also at that time that the nozzles 70 which are located towards the laying plane which is opposite to the side where is located the forward edge 73 of the flap 72, i.e. the nozzles located on the right-hand side of FIG. 5 are started to operate. They would generate air jets 71 which are impinging upon the lower surface of the disengaged end of the flap 72 besides retained in the swinging unit 11. The pressure air cushion thus formed would hold the zone of the forward edge 73 in the position shown. It should be pointed out that the angle $\alpha$ formed by the forward edge zone and the laying plane is advantageously below 30° to provide for the proper positioning of the forward edge 73 further on the top face of the receiving table 47 when the latter has returned to its lifted or upper working position. In view of its angular position shown the brush 35 may contribute to hold the flaps 73 in a well defined position promoting the later proper laying down of the flap onto the table 47.

As to the lowering motion of the table it should be pointed out that the brake 44 is released and the actuator jack 49 causes this table to move quickly downwards. The latter is shaped as a comb and passes through the belts of the conveyor track 53. The closure of the switching contact elements 27 and 57 would stop the lowering of the table and operate the switching on of the motor 54 which would initiate the movements of the belts 52 of the discharge track 53 in order that it discharges the completed pile or package as shown on FIG. 1. When the discharge of the pile is completed the actuator jack 49 causes the receiving table 47 to be lifted quickly again until the boss 57 triggers the switch 56 which controls the end of the raising motion of the table, the application of the brake 44 and triggers again the devices driving the web 3 in order that the swinging unit 11 and the flattening units 13 may form the new pile. Of course as soon as the table has returned to its raised position, the nozzles are caused to be stopped so that the flap 72 may lay itself down onto the table 47.

It should be understood that various modifications may be brought to the invention. Thus for instance the number of nozzles may be greater in accordance with the sizes of the flaps.

What is claimed is:

1. A method for forming individual zigzag folded piles from an endless web made from a flexible material such as paper and containing flaps defined by transverse perforation lines, in a pile forming machine comprising a pile support table and, above said table, a web guiding swinging unit making a pivoting movement above said table, said method comprising the steps of continuously feeding said endless web to said swinging unit and causing said unit to deposit the continuously forward-moving web on said table in a zigzag folded file configuration, rupturing the web along a transverse perforation line between the last flap of the folded pile and the first flap of a new pile to be formed, continuing the forward motion of the ruptured web until the last flap has been laid down on the folded pile and a forward end of the first flap reaches a position corresponding to its final position at the base of the new pile to be formed, stopping the swinging device and the forward motion of the web, moving said support table away from a pile-forming position to a distant pile discharge position, providing a cushion of gaseous fluid such as air under pressure in a zone located below said forward edge of said first flap, causing said cushion to support said forward edge zone and to form a temporary support during the absence of the supporting table, moving said supporting table back to its pile-forming position after the discharge of the completed pile so that said forward edge zone contacts said supporting table, stopping the formation of said gaseous fluid cushion under said forward edge zone of said first flap and restarting the operation of the swinging unit and the forward motion of said web.

2. Method according to claim 1, wherein said temporary support cushion is formed by directing gaseous fluid jets under the surface of said forward edge zone of said first flap.

3. A method according to claim 1, further consisting in adjusting the temporary supporting cushion so that the zone of said forward edge of the first flap by held in a position wherein this zone forms with respect to a horizontal plane an angle $\alpha$ small enough to provide for the proper positioning of said forward edge zone onto said table.

4. A method according to claim 3, wherein said predetermined angle $\alpha$ is smaller than 30°.

5. Apparatus for forming zig-zag folded piles from a continuous forward-moving web of flexible material containing flaps defined between transverse folding lines, comprising a pile support table movable between a pile-forming position and a distant pile discharge position;

a swinging unit adapted to pivot above said support table such that the web is deposited on said support table in a zig-zag configuration;

means for feeding the web to said swinging unit;

means for separating the web along a predetermined one of said folding lines between a flap intended to become the last flap to be laid down on the pile being formed on said support table and a flap intended to become the first flap on a new pile to be formed, means for controlling the pivoting movement of said swinging unit;

means for controlling the motion of said support table;

said means for feeding said web and said means for controlling the pivoting movement of the swinging unit adapted to stop the forward motion of the web and the pivoting movement of said swinging unit when a forward edge of the first flap reaches a position corresponding to its position at the base of the new pile to be formed; and means for generating a pressure fluid cushion in proximity to the pile-forming position of said support table when said support table is in its pile discharge position such that said cushion supports the forward edge of the first flap at a position corresponding to the position of the first flap at the base of a new pile to be formed.

6. Apparatus according to claim 5, wherein said pressure fluid cushion generating means comprises a plurality of nozzles adapted to produce gaseous fluid jets and are located on each side of the support table parallel to the folding lines of the flaps laid down on said support table, the nozzles located on one side of said support table being adapted to direct said air jets towards the other side of said support table and arranged such that said jets come into contact with a lower face of the forward edge zone.

7. A device according to claim 6, wherein at least two nozzles are arranged on either side of the supporting table and adapted to produce substantially parallel jets.

8. A device according to claim 6, wherein the nozzles are arranged between the laying plane of the supporting table and the lowermost point of the path of travel of the free end of the swinging unit and the nozzles located at one side of the table are providing the temporary supporting air cushion for a flap to be held on the other side of the table.

9. A device according to claim 6, wherein the strength of the fluid jets is adjustable in accordance with the substance and the size of the material constituting the flaps.

* * * * *